US010920168B2

(12) United States Patent
Horng et al.

(10) Patent No.: US 10,920,168 B2
(45) Date of Patent: Feb. 16, 2021

(54) COFFEE LUBRICANT HAVING NANOPARTICLES

(71) Applicant: NATIONAL FORMOSA UNIVERSITY, Huwei Township, Yunlin County (TW)

(72) Inventors: Jeng-Haur Horng, Huwei Township, Yunlin County (TW); Chin-Chung Wei, Huwei Township, Yunlin County (TW); Shin-Yuh Chern, Huwei Township, Yunlin County (TW); Kuang-Hsuan Peng, Huwei Township, Yunlin County (TW); Yang-Yuan Chen, Huwei Township, Yunlin County (TW); Chia-Chun Yu, Huwei Township, Yunlin County (TW)

(73) Assignee: NATIONAL FORMOSA UNIVERSITY, Huwei Township, Yunlin County (TW)

( * ) Notice: Subject to any disclaimer, the term of this patent is extended or adjusted under 35 U.S.C. 154(b) by 29 days.

(21) Appl. No.: 16/425,833

(22) Filed: May 29, 2019

(65) Prior Publication Data

US 2020/0377816 A1 Dec. 3, 2020

(51) Int. Cl.

| | |
|---|---|
| ***C10M 169/04*** | (2006.01) |
| ***C10M 109/00*** | (2006.01) |
| ***C10M 103/06*** | (2006.01) |
| ***C10M 105/14*** | (2006.01) |
| ***C10M 159/02*** | (2006.01) |
| ***C10M 111/06*** | (2006.01) |
| *C10N 20/02* | (2006.01) |
| *C10N 50/00* | (2006.01) |

(52) U.S. Cl.

CPC ..... *C10M 169/041* (2013.01); *C10M 103/06* (2013.01); *C10M 105/14* (2013.01); *C10M 109/00* (2013.01); *C10M 111/06* (2013.01); *C10M 159/02* (2013.01); *C10M 169/04* (2013.01); *C10M 2201/0623* (2013.01); *C10M 2207/0203* (2013.01); *C10N 2020/02* (2013.01); *C10N 2050/015* (2020.05)

(58) Field of Classification Search

CPC ..... C10M 169/041; C10M 111/06; C10M 109/00; C10M 105/14; C10M 103/06; C10M 159/02; C10M 2201/0623; C10M 2207/0203; C10N 2050/015; C10N 2020/02

See application file for complete search history.

(56) References Cited

FOREIGN PATENT DOCUMENTS

| | | | |
|---|---|---|---|
| TW | 201533234 A | | 9/2015 |
| TW | 2015033234 A | * | 9/2015 |

* cited by examiner

*Primary Examiner* — Taiwo Oladapo
(74) *Attorney, Agent, or Firm* — Cheng-Ju Chiang

(57) ABSTRACT

A coffee lubricant having nanoparticles is provided. It consists of 36 to 40 wt % of glycerin, 1 to 7 wt % of gum arabic, 0.3 to 1.3 wt % of nanoparticles, and remaining part of coffee biofuel. In which, the nanoparticles are CuO. The coffee biofuel is extracted from coffee dregs and has a viscosity of 60 to 70 cSt at a temperature of 40 degrees Celsius. It can reduce the friction coefficient and operating temperature. In addition, it can replace the mineral oil.

4 Claims, 1 Drawing Sheet

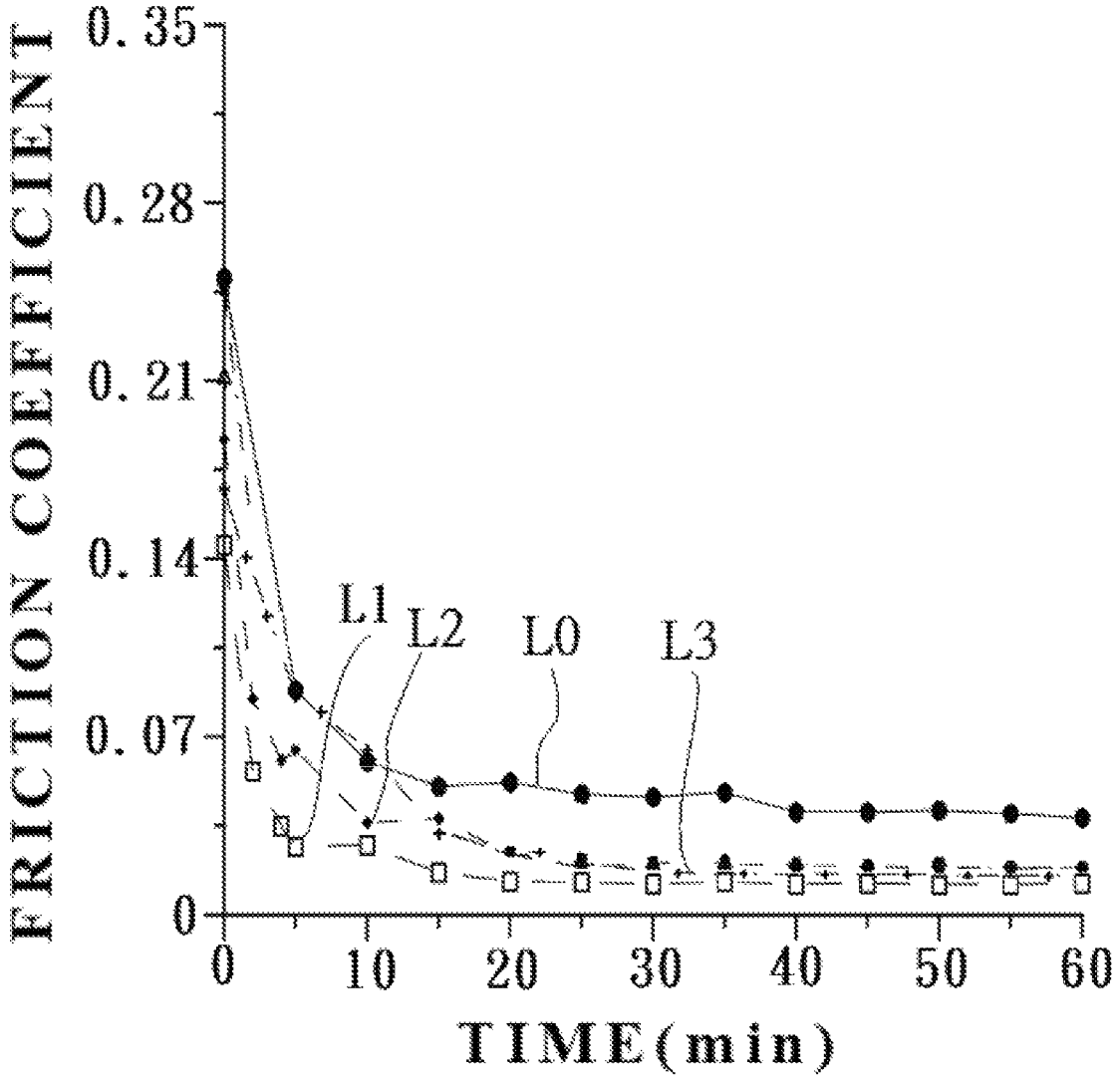
FRICTION COEFFICIENT
0.35
0.28
0.21
0.14
0.07
0
L1
L2
L0
L3
0
10
20
30
40
50
60
TIME(min)

COFFEE LUBRICANT HAVING NANOPARTICLES

BACKGROUND OF THE INVENTION

1. Field of Invention

The present invention relates to a coffee lubricant having nanoparticles. It can reduce the friction coefficient and operating temperature. In addition, it can replace the mineral oil.

2. Description of the Prior Art

The traditional lubricant consists of a base oil and one or more additives. Most of the base oil is mineral oil. The additive could be antifoaming agent, diffusion agent, antioxidants, detergent, or rust inhibitor. The function of the traditional lubricant is to use in automobile engines, motorbike engines, and all kinds of machines, in order to reduce the friction between machine parts. Also, it can reduce the frequency of machine part replacement.

The mineral oil is refined from the crude oil. Because of the increase of global population and the over-exploitation of crude oil, the fossil fuel resource might be exhausted in the future. During the oil-refining process, large amount of carbon dioxide is generated. The global warming problem is deteriorated. Accordingly, it significantly influences the global bio-environment and the climate change.

The mineral oil is refined from the crude oil and mainly consists of hydrocarbon. It is viscous. When this mineral oil is added into the interface between two machine parts of a running machine, an oil film is formed between these two machine parts so that the friction can be reduced. Hence, it can the prolong the product life of the machine. However, if the mineral oil is too viscous, the friction will be increased. In addition, it will cause the operation temperature too high. When such machine parts are working under a high temperature environment, it will cause the mechanical wearing problem as well as will reduce it product life.

Therefore, the mineral oil has the disadvantages of higher friction problem and non-ecofriendly problem.

In addition, the Taiwanese patent publication number TW-201533234 already disclosed a coffee biolubricant. It contains 60 to 70 wt % of mineral oil, 16 to 20 wt % coffee biofuel, and 14 to 20 wt % of active agent. Furthermore, this coffee biofuel is extracted from coffee (especially coffee dregs, by existing technology). But its mineral oil is more than 60%. Thus, it also has the disadvantages of higher friction problem and non-ecofriendly problem.

SUMMARY OF THE INVENTION

The object of this invention is to provide a coffee lubricant having nanoparticles. It can reduce the friction coefficient and operating temperature. In addition, it can replace the mineral oil. Particularly, it can solve the traditional problems such as it has a higher friction coefficient and the it is bad for our environment.

Therefore, a coffee lubricant having nanoparticles is provided. It consists of:

[a] 36 to 40 wt % of glycerin;

[b] 1 to 7 wt % of gum arabic;

[c] 0.3 to 1.3 wt % of nanoparticles; and

[d] remaining part of coffee biofuel;

wherein the nanoparticles are CuO;

the coffee biofuel is extracted from coffee dregs and has a viscosity of 60 to 70 cSt at a temperature of 40 degrees Celsius.

BRIEF DESCRIPTION OF THE DRAWINGS

The FIGURE shows the relationship between the time and the friction coefficient of the preferred embodiments in this invention.

DESCRIPTION OF THE PREFERRED EMBODIMENT

The present invention is a coffee lubricant having nanoparticles. It comprises:

[a] 36~40 wt % of glycerin;

[b] 1~7 wt % of gum arabic;

[c] 0.3~1.3 wt % of nanoparticles; and

[d] remaining part of coffee biofuel;

In which, the nanoparticles are CuO. The coffee biofuel is extracted from coffee dregs and has a viscosity of 60~70 cSt at a temperature of 40 degrees Celsius.

Practically, about the Example 1 of this invention, the coffee biofuel is 58.6 wt %; the glycerin is 39.0 wt %; the gum arabic is 2.0 wt %; and the nanoparticles is 0.4 wt %.

Practically, about the Example 2 of this invention, the coffee biofuel is 58.1 wt %; the glycerin is 38.8 wt %; the gum arabic is 1.9 wt %; and the nanoparticles is 1.2 wt %.

Practically, about the Example 3 of this invention, the coffee biofuel is 55.7 wt %; the glycerin is 37.1 wt %; the gum arabic is 6.1 wt %; and the nanoparticles is 1.1 wt %.

Please refer to the following Table 1, it shows the detailed composition of the Examples 1, 2, and 3 of this invention.

TABLE 1

| Item | Coffee biofuel (g) | glycerin (g) | gum arabic (g) | CuO nanoparticles (g) |
|---|---|---|---|---|
| Example 1 | 15.00 | 10.00 | 0.5 | 0.1 |
| Example 2 | 15.00 | 10.00 | 0.5 | 0.3 |
| Example 3 | 15.00 | 10.00 | 1.64 | 0.3 |

The information in Table 1 can be converted into the weight percentage (wt %), as shown in Table 2.

TABLE 2

| Item | Coffee biofuel (wt %) | glycerin (wt %) | gum arabic (wt %) | CuO nanoparticles (wt %) |
|---|---|---|---|---|
| Example 1 | 58.6 | 39.0 | 2.0 | 0.4 |
| Example 2 | 58.1 | 38.8 | 1.9 | 1.2 |
| Example 3 | 55.7 | 37.1 | 6.1 | 1.1 |

With regard to the method to produce this invention, it is described as follows.

[step 1] Keep the room temperature at 25 degrees Celsius. Filter the coffee biofuel (that is extracted from coffee dregs) and then a filtered coffee biofuel of a required weight can be obtained.

[step 2] Add surfactant (the gum arabic) into the filtered coffee biofuel and mix them well by stirring.

[step 3] Add glycerin into the mixture obtained from the previous step and mix them well by stirring.

[step 4] Heat up the mixture obtained from the previous step to 80 degrees Celsius with proper stirring.

[step 5] Cool down to 40 degrees Celsius and check its viscosity in the range of 60~70 cSt or not.

[step 6] If not, repeat from step 4 until the required viscosity is obtained.

About the nanoparticles, it can be added before Step 4 (such as added in Step 2 or Step 3 while stirring).

About the experiment of this invention, it is based on an abrasion testing machine that utilizes a ring and a disk under a line contact movement. During the abrasion testing, a specific load (such as 60 N) and a specific rotation speed (such as 80 rpm) is set. Then, many testing results (such as the friction coefficient and the temperature) can be measured and recorded.

Referring to the FIGURE, it shows the actual abrasion resting results of the traditional mineral oil and this invention under three different mixing conditions (Examples 1, 2, and 3).

In the FIGURE, the X-axis means time and the Y-axis means the friction coefficient (or called coefficient of friction). The label L0 is the data of the traditional mineral oil. Labels L1 to L3 are the data of the Examples 1 to 3 (or called formula 1 to 3) of this invention.

Based on the FIGURE, after twenty minutes, the friction coefficients of the Examples 1, 2, and 3 are all better than the one of the traditional mineral oil. Especially, the Example 1 (or formula 1) is the best.

About the nanotechnology, it is well developed during these years. Some papers prove that the nanotechnology applied in the abrasion is able to improve the abrasion problem.

Therefore, this invention can reduce the friction coefficient of the working machine. Hence, it can decrease the heat generated caused by the friction. So, the product life of such machine or machine parts can be prolonged.

Also, this invention can replace the traditional mineral oil. Thus, it can reduce the crude oil over-exploitation and related refining processes, as well as to lower the air pollution.

The advantages and functions of this invention can be summarized as follows.

[1] The nanoparticles can reduce the friction coefficient and operating temperature. In this invention, because it can reduce the friction coefficient, the heat generated by the friction is decreased accordingly. Furthermore, it can prolong the product life of the machine or machine parts.

[2] It can replace the mineral oil. This invention can replace the mineral oil, so it can reduce the crude oil over-exploitation and related refining processes, as well as to lower the air pollution.

The above embodiments are only used to illustrate the present invention, not intended to limit the scope thereof. Many modifications of the above embodiments can be made without departing from the claims of the present invention.

What is claimed is:

1. A coffee lubricant consisting of:

[a] 36 to 40 wt % of glycerin;

[b] 1 to 7 wt % of gum arabic;

[c] 0.3 to 1.3 wt % of nanoparticles; and

[d] remaining part of coffee biofuel;

wherein said nanoparticles are CuO;

said coffee biofuel is extracted from coffee dregs and has a viscosity of 60 to 70 cSt at a temperature of 40 degrees Celsius.

2. The coffee lubricant as defined in claim 1, wherein:

said coffee biofuel is 58.6 wt %;

said glycerin is 39.0 wt %;

said gum arabic is 2.0 wt %; and said nanoparticles is 0.4 wt %.

3. The coffee lubricant as defined in claim 1, wherein:

said coffee biofuel is 58.1 wt %;

said glycerin is 38.8 wt %;

said gum arabic is 1.9 wt %; and said nanoparticles is 1.2 wt %.

4. The coffee lubricant as defined in claim 1, wherein:

said coffee biofuel is 55.7 wt %;

said glycerin is 37.1 wt %;

said gum arabic is 6.1 wt %; and said nanoparticles is 1.1 wt %.

* * * * *